US005288173A

United States Patent [19]

Jenne et al.

[11] Patent Number: 5,288,173

[45] Date of Patent: Feb. 22, 1994

[54] METHOD FOR THE DIRECTIONAL CONTROL OF AN EARTH BORING DEVICE AS WELL AS APPARATUS FOR MAKING EARTH BORES

[75] Inventors: Gustav Jenne, Essen, Fed. Rep. of Germany; Dietmar Jenne, Strengelbach, Switzerland

[73] Assignee: Terra AG fuer Tiefbautechnik, Strengelbach, Switzerland

[21] Appl. No.: 906,579

[22] Filed: Jun. 30, 1992

[30] Foreign Application Priority Data

Jul. 5, 1991 [DE] Fed. Rep. of Germany ..... 4122350

[51] Int. Cl.[5] ..... E21B 7/08

[52] U.S. Cl. ..... 405/184; 175/61; 175/62; 175/424

[58] Field of Search ..... 175/61, 62, 296, 424; 405/184

[56] References Cited

U.S. PATENT DOCUMENTS

| | | | |
|---|---|---|---|
| 4,718,118 | 12/1987 | Baker et al. | 175/61 X |
| 4,790,394 | 12/1988 | Dickinson et al. | 175/61 |
| 4,930,586 | 6/1990 | Turin et al. | 175/424 X |
| 4,991,667 | 2/1991 | Wilkes, Jr. et al. | 175/424 X |

*Primary Examiner*—Dennis L. Taylor
*Assistant Examiner*—Arlen L. Olsen

[57] ABSTRACT

In an earth boring device of either the impact ram or static type wherein the device is driven forwardly either by the impacts of an impact piston or by a forward pressure exerted on the device through a rod, directional control of the device is achieved by arranging a plurality of pressure fluid ejecting nozzles on the head of the device symmetrically with respect to its longitudinal axes, and by individually controlling the pressure and/or amount of pressure fluid supplied to each nozzle to deflect the device in one direction away from what would otherwise be its forward drive path.

6 Claims, 5 Drawing Sheets

Fig. 4
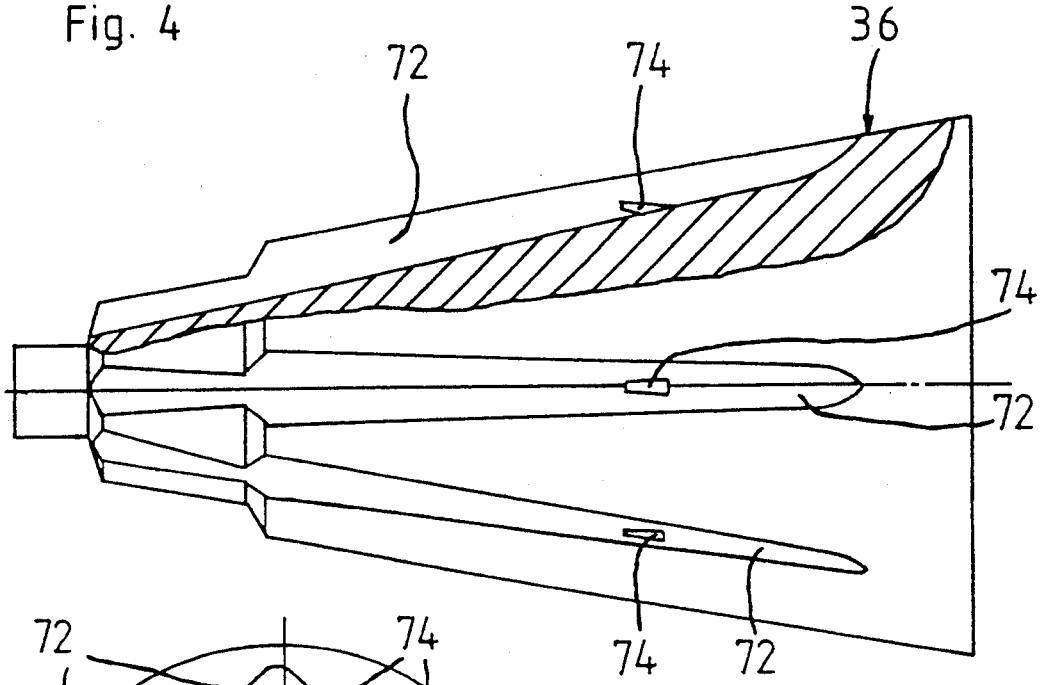
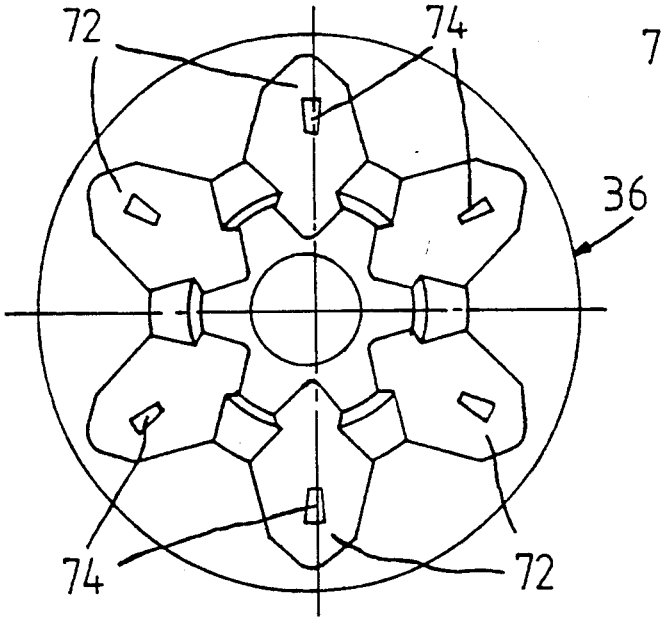
Fig. 5
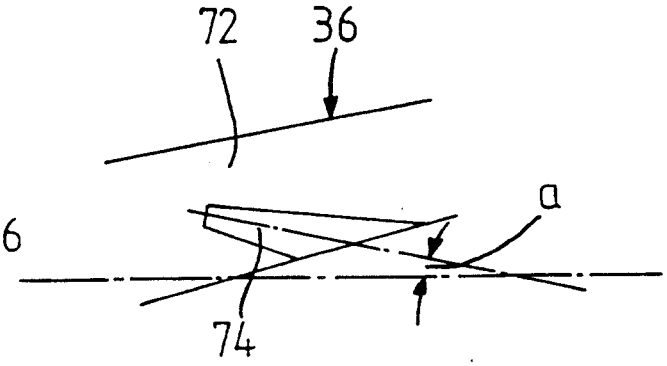
Fig. 6

METHOD FOR THE DIRECTIONAL CONTROL OF AN EARTH BORING DEVICE AS WELL AS APPARATUS FOR MAKING EARTH BORES

FIELD OF THE INVENTION

The invention concerns a method for the directional control of an earth boring device having a tubular housing and a head arranged coaxially to the housing wherein pressure fluid is conducted to jet nozzles formed in the head to deflect the housing from its forward drive direction, as well as an apparatus for making earth bores, especially for the carrying out of the previously mentioned methods.

BACKGROUND OF THE INVENTION

For the laying of cables and pipes in the ground small tunnels of diameters in the area of about 45 to 200 mm are needed in front gardens, under streets, railways, waterways and established surfaces, which tunnels are often made by means of percussive or impact boring devices. The displacement heads of customary devices of this type can exhibit quite good displacement and crushing characteristics resulting from special head shapes. They however are not controllable in their forward direction, so that in the case of simple devices of this type no possibility exists for controlling them around a curve or to correct for their deviation from the desired path.

To avoid these disadvantages different solutions have already been proposed. So it is known from DE-A-39 11 467 to provide an inclination on the forward side of the earth boring device. This inclination presses the head of the device toward one side upon penetrating the ground. To achieve a straight run such a head has to be continuously rotated about its longitudinal axis. Thereby the inclination during the forward movement of the device presses the device in sequence upwardly, to the right, downwardly and to the left, so that in the event of a uniform rotation of the head the device as a result moves in a straight line. A head with such an inclination has indeed no longer the necessary crushing and displacement characteristics making possible forward movement in inhomogeneous and firm types of ground.

To reduce the resistance at the point of the device head and to ease the forward movement of the device in certain cohesive and sandy types of ground it has already been proposed to break up or entirely wash away the ground directly in front of the device head by a strong fluid jet. In keeping with this, in US-A-4 674 579 an earth boring device is known which is asymmetric in the front and has an outlet for a fluid jet directed from one side and inclined to the axis of the device. Since the ground in the area of the fluid jet is deflected or washed away the ground in this area presents the least resistance to the earth boring device. Upon its forward drive the earth boring device therefore deflects in the direction of the fluid stream. Thereby it influences the forward movement direction of the device. For straight movement this bore head much like that of the above described device with an inclined head has to be continuously rotated. A disadvantage of this solution is that the mechanism required for rotating the head does not stand up long against the rough drive conditions. This is especially true for so-called ram boring devices wherein the dynamic hammer impacts needed for the advancement of the earth boring device are so strong that the elements for guiding and rotating the head become worn out in short time.

The same disadvantages are present in the earth boring device with symmetrical head known from US-A-4 714 118, on which several asymmetrically arranged jet nozzles are provided. These nozzles are either all opened or all closed. For straight path movement the bore head must again be rotated.

An earth borer is known from US-A-3 365 007 in the boring head of which nozzles are formed for the discharge of boring fluid. The fluid discharge through these nozzles can be controlled. Since the boring head for penetration into the ground must be rotated it must be stopped to change the boring direction. After the stopping of the boring head by controlling certain nozzles the ground is washed away in the desired place. When the borer is again driven, it moves into the washed out space and thereby deviates in the desired direction from its previous boring direction. A change of direction during the forward drive is in this case, however, not possible.

An earth borer according to US-A-3 746 108 also has the same disadvantage. It differs from the known solution of US-A-3 365 007 in that the jet nozzles on the boring head are arranged asymmetrically and are not selectively controllable. To be able to change the boring direction, again the boring head must be stopped and so oriented that the nozzles point in the desired direction. After the washing away of a lateral space the drive of the borer can again be resumed.

SUMMARY OF THE INVENTION

The invention has as its object the provision of a method of the previously mentioned type, as well as of an earth boring device for carrying out the method, in which the forward drive direction of the earth boring device can be changed as desired without the head of the earth boring device for this purpose having to be rotatable about is axis.

This object is solved by a method of the previously mentioned type in accordance with a first embodiment of the invention in that only the nozzle or nozzles are supplied with pressure fluid whose jet directions are facing at least nearly in the desired deflection direction of the earth boring device. It is provided, in accordance with another embodiment of the invention that the pressure of the pressure fluid at the nozzle or nozzles whose jet direction faces at least nearly in the desired deflection direction of the earth boring device is higher than the pressure of the pressure fluid at the other nozzles.

In the inventive solution the directional control of the earth boring device is further so effected that the pressure fluid to each nozzle is individually adjustable as to the pressure and/or the quantity of the pressure fluid. By selection of the jet nozzles which are supplied with pressure fluid and/or by selecting the pressure the degree of the breaking up of the earth in a desired angular region around the head of the earth boring device can be so carried out that by means of this breaking up a large or a small change in direction of the earth boring device can be produced, since in the broken up region of the earth the head of the earth boring device has applied to it a reduced resistance, and the displacement head of the earth boring device inherently deflects toward the side of least resistance.

Preferably, additional jet nozzles are arranged in the tube shaped housing, each of which, in the longitudinal direction of the earth boring device, is aligned with at least one of the jet nozzles of the head and each of which is supplied with pressure fluid in the same way as is the jet nozzle of the head which is aligned with it. Therefore, the breaking up of the ground by the pressure fluid for a change of direction takes place not only in the area of the head but also in the area of the housing. The earth is simultaneously broken up along a longer length, so that the deflection of the earth boring device along a short stretch of its forward drive motion is possible, that is, curves with small radii can be achieved for the path of the earth boring device.

Since in the earth boring device of the invention the head need not be brought into rotation, the earth boring device can be driven forwardly during the discharge of the pressure fluid through the nozzles. In this way, especially in the case of ram boring devices, a high forward drive speed is achieved.

The pressure of the pressure fluid of the nozzles facing in the desired deflection direction can, according to the type of earth, be varied between about 20 to 250 Bar. To facilitate the forward drive of the earth boring device by improving its sliding characteristics, a pressure fluid can be used having thixotropic or lubricating properties.

A device for making earth bores, especially for carrying out a method of the previously described kind, includes an earth boring device with a tubular shaped housing and a head arranged coaxial with the housing as well as means for driving the earth boring device forwardly, with the head of the earth boring device having at least three nozzles arranged thereon which are connectable to a fluid pressure source, with means being provided in accordance with the invention to individually control the delivery of pressure fluid to each nozzle or to individually control the pressure and/or quantity of pressure fluid supplied to each nozzle. With regard to the change of the pressure or the quantity of the pressure fluid it can also be provided that the jet angle of each nozzle is adjustable.

If the ability to break up a large surface area region of the earth in a predetermined direction is needed, it is advantageous if a plurality of nozzles are arranged behind one another in the longitudinal direction of the earth boring device. Then, if the jet angles of the nozzles are changeable, there especially results a large abundance of control possibilities.

For trouble-free straight line movement of the device it is advantageous if the nozzles are arranged symmetrically with respect to the longitudinal axis of the boring device. By shutting off all nozzles or by supplying all nozzles with the same amount of pressure fluid and the same pressure the straight line forward movement of the device is assured, so long as the ground is substantially homogeneous.

With the exception of the arrangement of the nozzles, the head of the earth boring device can be made in the usual way. Therefore, the head can be formed with a conical shape and on its conical surface can be provided with spaced grooves arranged symmetrically with respect to the axis, in which grooves the nozzles are arranged. In contrast to these purely displacement heads the head can also be formed with a stepped shape and likewise can have longitudinal grooves arranged symmetrically with respect to the axis, in which grooves the nozzles are again arranged. The stepped head exhibits better crushing properties.

For delivery of the pressure fluid to the nozzles the nozzles are advantageously connected with channels running parallel to the axis in the housing wall, with the channels at their ends remote from the head being connected to the pressure fluid source through flexible conductors. Therefore, the inner space of the housing of the earth boring device remains free in order for example to allow for the reception in that space of the impact piston of a ram device. The control valves for controlling the pressure fluid delivery to the individual nozzles can be provided either in the earth boring device itself or on the pressure fluid source. The last embodiment has the advantage that the control conductors for controlling the valves are short and need not be pulled along with the earth boring device.

The earth boring device can, in a way known in itself, be pressed into the earth through a rod attached to it at its end remote from the head, with a vibration dampener being built in between the earth boring device and the rod for protecting them from damage by the impacts of the ram device.

To make possible the under water use of an earth boring device formed as a ram device it is advantageous if the exhaust of the pneumatic ram apparatus be discharged rearwardly through a watertight conductor.

In order to easily determine the position and orientation of the earth boring device at each point in time, and to be able to supervise the same, a sender of known kind can be provided in the head of the earth boring device which transmits suitable position signals.

Further features and advantages will be apparent from the following description which in conjunction with the accompanying drawings explain the invention by way of an exemplary embodiment.

BRIEF DESCRIPTION OF THE DRAWINGS

FIG. 4 A side view of a conical head of an earth boring device embodying the invention.

FIG. 5 A front view of the head illustrated in FIG. 4.

FIG. 6 A detailed view, in enlarged scale, of a single nozzle of the head illustrated in FIG. 4.

DETAILED DESCRIPTION OF THE PREFERRED EMBODIMENTS

Figure 1:
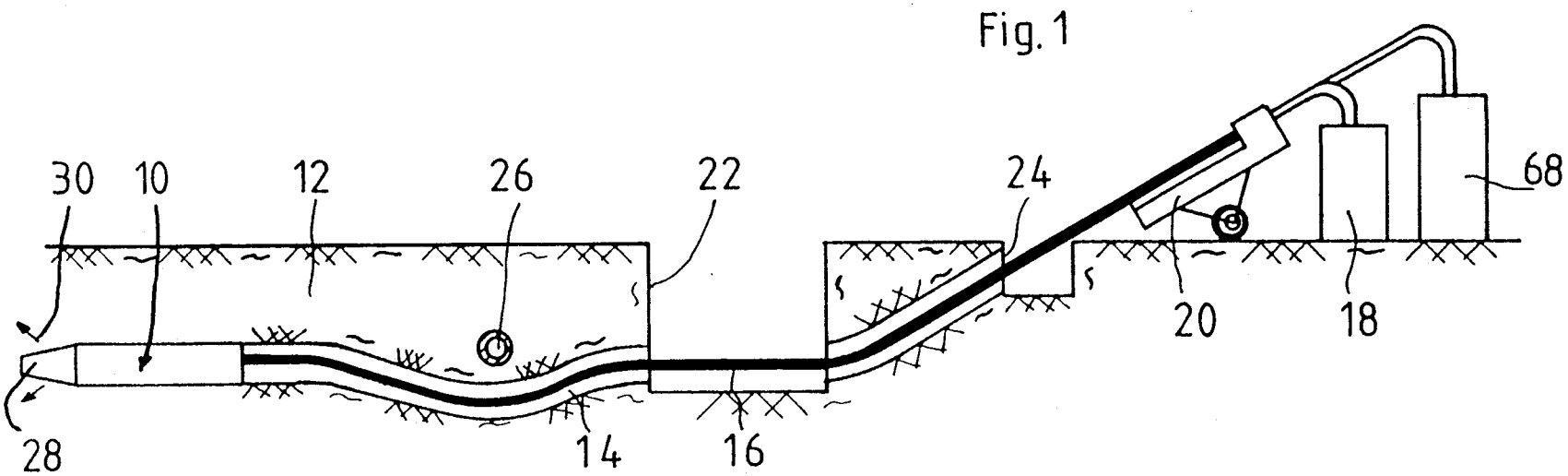
FIG. 1 A schematic illustration of the working method and of the use of an earth boring device constructed as a ram boring device.

An earth boring device is indicated generally at 10 in FIG. 1, by the help of which a tubular hole 14 is to be created in the earth, into which a cable or pipe can subsequently be laid. The earth boring device 10, which is hereinafter described in more detail in connection with FIG. 3, constitutes a ram boring device which by the impacts of an axially movable impact piston contained in its cylindrical housing can be driven through the earth 12. The impact piston is driven by pressurized air delivered from a pressurized air source 18 through a hollow rod 16. The rod 16 serves at the same time to exert a further driving force onto the earth boring device 10. At a boring slide illustrated only schematically at 20 the rod is lengthened according to the forward motion of the earth boring device 10 and has the forward driving force applied to it. The ditches 22 and 24 illustrated in the drawing serve as connecting ditches and start and entrance ditches for the earth boring device 10 and the rod 16.

The arrangement as so far described is known in itself and need not be more specifically described with regard to its technical features and functions. In the customary devices of this type the basic problem appears of how the desired drive direction of the earth boring device 10 can be maintained or can be changed in a desired way. For illustration of these problems a tubular conductor 26 is shown to be lying in the earth 12. This conductor 26 crosses the hole 14 to be made in the earth and therefore must be passed by the earth boring device 10. Such a deflecting maneuver requires that the earth boring device can be correspondingly controlled. In the present invention this is achieved in that in general nozzles are associated, in a yet to be described way, with the illustrated head 28 of the earth boring device through which fluid can be ejected into the earth aimed in a given direction at a pressure between 20 to 250 Bar which fluid likewise can be delivered through the rod 16 or through a separate conductor, as shown in FIG. 1 by the arrow 30 on the head 28. By means of the pressure fluid streams the earth is broken up or washed away so that in this area the earth boring device 10 encounters a reduced resistance. The earth boring device will then be deflected toward this area of reduced resistance as it is driven forwardly.

The exact construction of the earth boring device will now be explained in more detail with reference to FIGS. 3 to 8.

Figure 3:
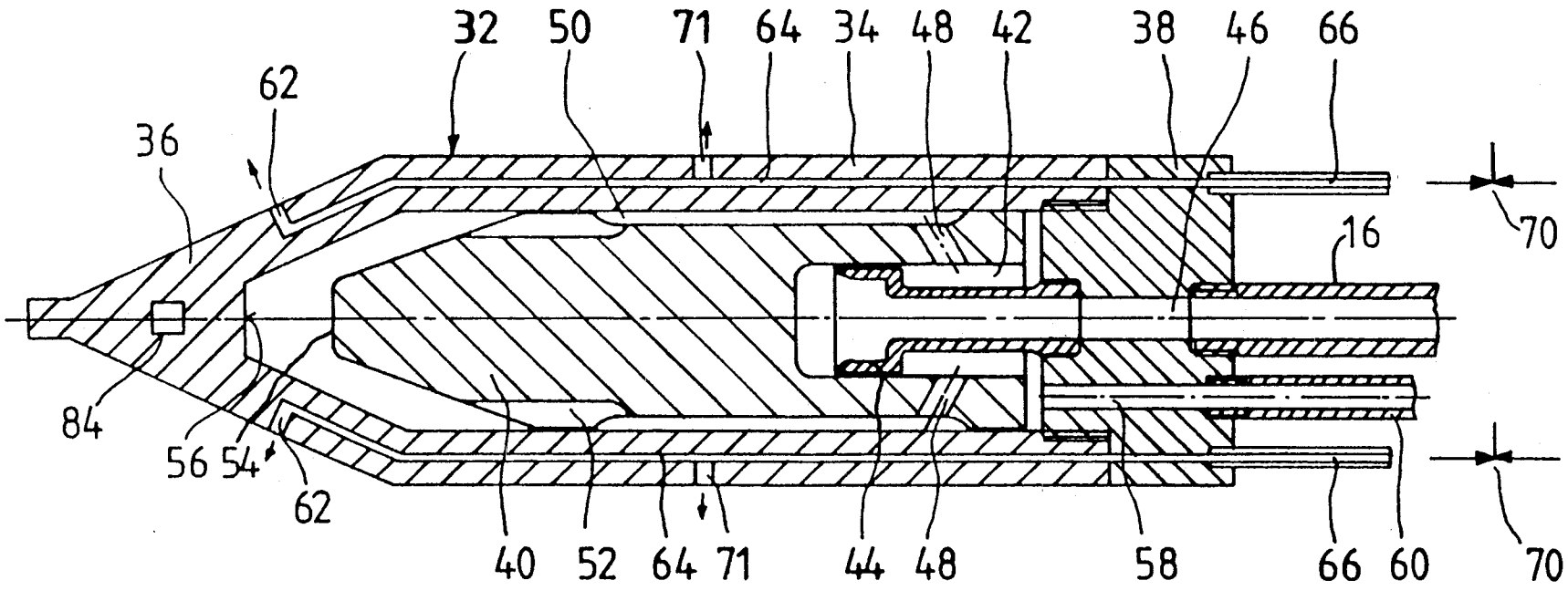
FIG. 3 A cross sectional view taken on a plane containing the axis of the ram boring device of FIG. 1.

The ram boring device schematically illustrated in FIG. 3, in a section containing its axis, includes a housing designated generally by the reference number 32 with a cylindrical section 34 and a conical head 36. At its end remote from the head the housing 32 is closed by a closure part 38 threaded into the cylindrical portion 34.

An impact piston 40 is guided for axial sliding movement in the housing 32. At its end facing away from the head 36 the impact piston has a pocket bore 42 into which a control tube 44 extends, the control tube 44 being threadably connected with the closure part 38 and through a bore 86 passing through the closure part 38 being connected with the rod 16 serving as the pressurized air delivery conductor. The pocket bore 42 is connected with an annular space 50 by radially directed channels 48, which annular space 50 is formed by a reduced diameter portion of the impact piston 40 between itself and the housing wall which surrounds it. This annular space is connected with the inner space of the housing 32 located ahead of the impact piston 40 by longitudinal grooves in the forward area of the impact piston. The ram bore device as so far described is known in itself and works in the following way: upon delivery of pressurized air through the rod 16, the bore 46 and the control tube 44, the impact piston 4 is accelerated forwardly (in FIG. 1 toward the left). Shortly before the impact piston reaches with its forward face 54 the impact surface 56 on the head 36, the radial bores 48 come into connection with the forward end of the control tube 44, so that pressurized air can reach the hollow space in front of the impact piston 40 through the radial bores 48, the annular space 50 and the longitudinal grooves 52. This pressurized air reaches the forward face 54 of the impact piston at the moment of its rebound and pushes the impact piston 40 back again. Before the impact piston 40 can strike the closure piece 38 the pressurized air, as illustrated in FIG. 3, can exhaust from the forward portion of the housing hollow space through the longitudinal grooves 52, the annular space 50 and the radial bores 48 as well as through an exhaust bore 58 running parallel to the axis in the closure part 38, which exhaust bore 58 is connected with an exhaust hose 60. The pressurized air contained in the interior of the control tube 44 smoothly brakes the impact piston in its rearward position, so that it does not strike onto the closure piece 38.

Nozzle openings 62 are formed on the head 36, each of which is connected with a respective one of channels 64 running inside the housing wall and through the closure piece 38 and connected with pressure fluid conductors 66 connected to the closure piece 38. Pressurized fluid, which escapes from the nozzle openings 62 in sharp jets is delivered from a pressure fluid source 68, illustrated schematically in FIG. 1, through the channels 64 and the conductors 66. The delivery to the individual nozzles is controlled by the control valves 70, indicated schematically in FIG. 3, which in the present example are arranged in the pressure fluid source 68. With these control valves 70 the amount and/or the pressure of the pressure fluid delivered to the individual nozzle openings 62 can be individually adjusted to achieve the above described directional control of the earth boring device 10.

Further nozzle openings 71 are provided in the cylindrical portion 34 of the housing 32. The nozzles 71 each lie, with reference to the longitudinal axis of the earth boring device 10, in alignment with a corresponding one of the nozzles 62, as shown FIG. 3. Through them fluid can be injected between the cylindrical section 34 and the surrounding earth to facilitate the sliding of the earth boring device relative to the earth. Also by selected control of these lateral nozzles 71 in combination with their associated nozzles 62 on the head 36 the earth can be broken up over a long stretch so that a change of direction can be accomplished within a small stretch of the path of forward travel.

FIGS. 4 to 7 show two earth boring device heads known in themselves onto which jet nozzles corresponding to the present invention have been arranged. These heads, although shown as individual pieces, can also be made of one piece with the cylindrical section of the housing 32, as illustrated in FIG. 3.

FIGS. 4 and 5 show a conical displacement head with longitudinal grooves 72 in which jet nozzles 74 are arranged which in contrast to the nozzle opening 62 in FIG. 3 direct the pressure fluid jets at a pre-given angle a inclined to the forward direction (FIG. 6). As can be seen from FIG. 5 the grooves 72 and the nozzles 74 are spaced at equal angles symmetrically around the axis of the head.

Figure 7:
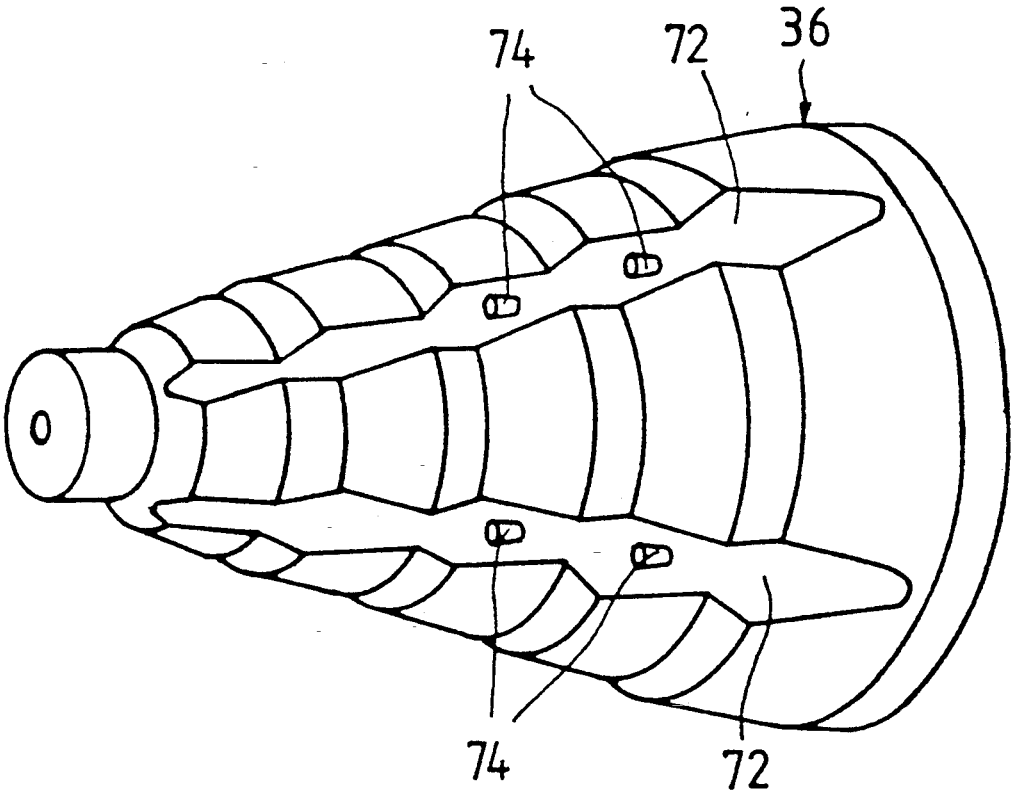
FIG. 7 A perspective view of a stepped head of an earth boring device embodying the invention.

FIG. 7 shows a stepped head having better crushing characteristics for use in hard and stone containing earth. This head also has longitudinal grooves 72 in each of which, in this case by way of example two, jet nozzles 74 are arranged behind one another and whose jet angles can be chosen to be similar or different from one another to increase the control possibilities. In this case the nozzles in each of the longitudinal grooves can either be connected to a common pressure fluid conductor or to separate pressure fluid conductors.

Figure 9:
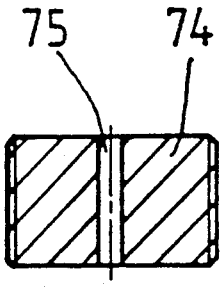
FIGS. 9 and 10 Each a schematic sectional view of a nozzle.
Figure 10:
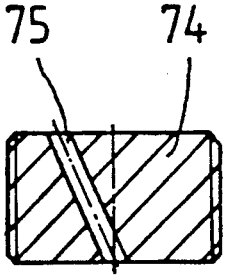

Nozzle bodies 74 are illustrated in each of FIGS. 9 and 10, each of which is in the form of a slotted screw threadable into an associated nozzle opening 62 and through which a nozzle channel 75 runs. In the case of the nozzle body 74 of FIG. 9 the nozzle channel 75 is axially directed, whereas in the embodiment according to FIG. 10 the nozzle channel is formed at an angle to the thread axis. By the use of nozzle bodies with differently formed jet channels the jet angle of the nozzles can be adjusted. Also, in the case of a slantingly directed nozzle channel, by rotating the nozzle body the jet direction can be changed.

Figure 8:
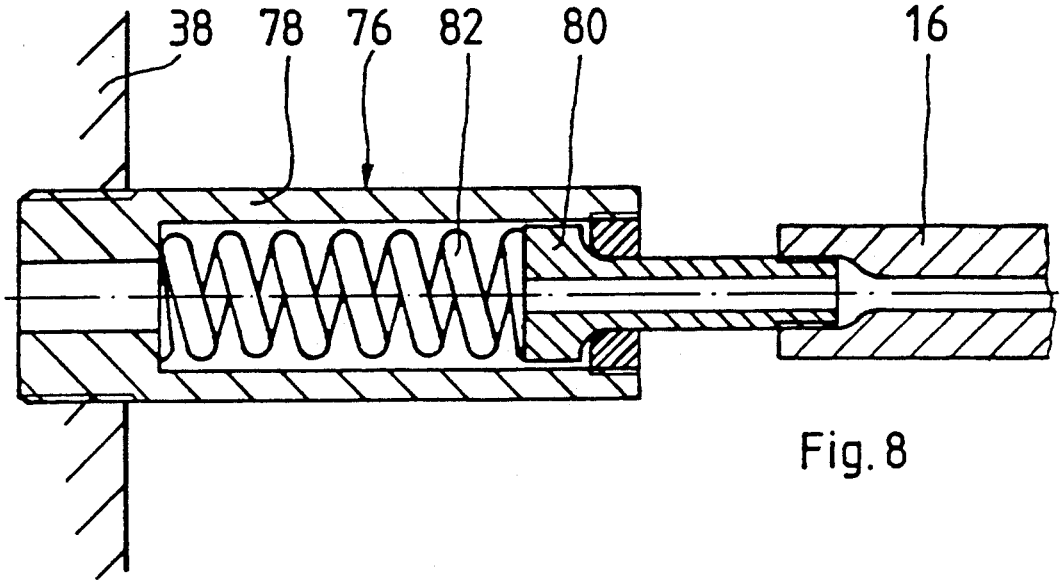
FIG. 8 A sectional view taken on a plane passing through the axis of a vibration dampener between a ram boring device according to FIG. 3 and a drive rod.

FIG. 8 shows a vibration dampener, indicated generally at 76, used between the closure part 38 and the rod 16 to reduce damage to them by the ram impacts of the ram boring device. The vibration dampener includes a cylindrical housing 78 threaded with one of its ends into the closure part 38 and serving as a guide for a piston 80 connected to the rod 16, with a dampening spring 82 being arranged between the end surface of the housing 78 facing away from the closure part 38 and the piston 80.

Figure 2:
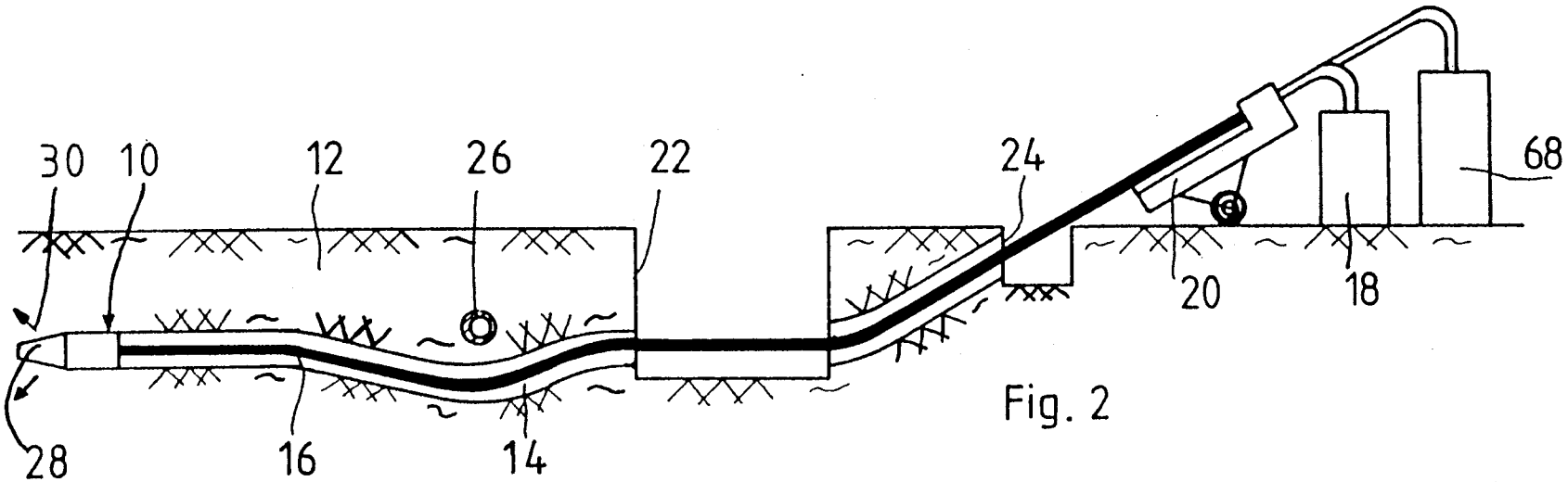
FIG. 2 An illustration corresponding to FIG. 1 showing a static earth borer.

In the previous description a ram boring device is described as the especially preferred embodiment. The control with the help of nozzles arranged on the head of the ram boring device and through which nozzles fluid pressure jets are emitted can, however, also be used with a static earth boring device, as illustrated schematically in FIG. 2. This earth boring device is not driven forwardly by ram impacts of an impact piston but instead by the forward pressure exerted on it through the rod. Moreover, that which has been said for the previously described ram boring device applies in similar way also to such a static earth boring device. Both types of devices have in comparison to the previously known solutions the advantage that the control of the nozzles for the purpose of changing direction can take place during the forward drive of the device.

In both exemplary embodiments a sender 84, as illustrated schematically in FIG. 3, can be arranged on the head 36 of the earth boring device, which sender makes possible a satisfactory determination of the position of the earth boring device.

We claim:

1. A method for directional control of an earth boring device which includes a tubular shaped housing and a head arranged coaxially to the housing whereby for deflecting itself from its axial forward drive direction pressure fluid is conducted to jet nozzles formed in the head before or during the drive of the earth boring device, characterized in that the nozzle or nozzles whose jet directions at least nearly face the deflection direction are supplied with pressure fluid in a manner different from the way in which pressure fluid is supplied to the other nozzles, in that further jet nozzles are arranged in the tubular shaped housing which nozzles in the longitudinal direction of the earth boring device are each aligned with at least one of the jet nozzles of the head, and that each of said further nozzles is supplied with pressure fluid in the same way as is the jet nozzle of the head aligned with it.

2. An apparatus for making earth bores including an earth boring device with a tubular housing and a head arranged coaxially to the housing, as well a means for driving the earth boring device forwardly, whereby at least three nozzles are arranged in the head of the earth boring device which are connectable to a pressure fluid source, characterized in that the pressure fluid delivery to each nozzle is individually controllable with respect to pressure and/or quantity of pressure fluid, and in that further nozzles are arranged in the tubular housing each of which is aligned, with respect to the longitudinal direction of the earth boring device, with at least one jet nozzle of the head.

3. An apparatus according to claim 2, further characterized in that the head of the earth boring device is formed conically and has grooves on its conical surface symmetrical with respect to the axis of the earth boring device and in which grooves the nozzles are arranged.

4. An apparatus according to claim 2, further characterized in that the earth boring device is formed as a dynamic ram boring device.

5. An apparatus according to claim 4, further characterized in that the housing of the ram boring device is connected with a watertight exhaust conductor which carries away the pressurized air necessary for driving an impact piston of the ram boring device.

6. An apparatus according to claim 2, further characterized in that the earth boring device is connected with a rod through which a forward pushing force can be exerted onto earth boring device, an in that a vibration dampener is arranged between the earth boring device and the rod.

* * * * *